US008806798B2

(12) United States Patent
Crispin

(10) Patent No.: US 8,806,798 B2
(45) Date of Patent: Aug. 19, 2014

(54) RIFLESCOPE ADJUSTMENT KNOB WITH INTERCHANGEABLE ADJUSTMENT INDICATOR RING

(71) Applicant: Quint Crispin, Beaverton, OR (US)

(72) Inventor: Quint Crispin, Beaverton, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 13/683,985

(22) Filed: Nov. 21, 2012

(65) Prior Publication Data

US 2014/0137458 A1 May 22, 2014

(51) Int. Cl.
*F41G 1/38* (2006.01)

(52) U.S. Cl.
USPC ..... 42/119; 74/553

(58) Field of Classification Search
USPC ..... 42/119, 122, 135, 136, 137; 359/399, 359/429; 74/553
See application file for complete search history.

(56) References Cited

U.S. PATENT DOCUMENTS

| | | | | |
|---|---|---|---|---|
| 3,082,643 | A * | 3/1963 | Grassi et al. | 74/553 |
| 3,132,625 | A * | 5/1964 | Oram | 116/231 |
| 3,410,247 | A * | 11/1968 | Dronberger | 116/311 |
| 3,910,308 | A * | 10/1975 | Mack | 137/553 |
| 6,279,259 | B1 * | 8/2001 | Otteman | 42/122 |
| 6,772,550 | B1 * | 8/2004 | Leatherwood | 42/119 |
| 7,612,952 | B2 * | 11/2009 | Schafer | 359/813 |
| 7,624,526 | B2 * | 12/2009 | Paasikivi et al. | 42/111 |
| 7,997,163 | B2 | 8/2011 | Casas | |
| 8,001,714 | B2 | 8/2011 | Davidson | |
| 2007/0240356 | A1 * | 10/2007 | Klepp et al. | 42/122 |
| 2008/0289239 | A1 | 11/2008 | Menges et al. | |
| 2010/0175298 | A1 * | 7/2010 | Thomas et al. | 42/122 |
| 2013/0167425 | A1 * | 7/2013 | Crispin | 42/119 |
| 2013/0232846 | A1 | 9/2013 | Wagner et al. | |

OTHER PUBLICATIONS

Stoney Point, Stoney Point Target Knob, www.natcherss.com/product.cfm?contentID=productDetail& prodID=SQ046002, last visited Oct. 1, 2012, 2 pgs.

* cited by examiner

*Primary Examiner* — Gabriel Klein
(74) *Attorney, Agent, or Firm* — Stoel Rives LLP

(57) ABSTRACT

An adjustment device having a rotatable knob for changing an adjustable setting of an aiming device, such as a riflescope. The knob includes a removable indicator ring slidable onto the knob and bearing a scale to provide visual feedback to a shooter regarding an adjustment position of the adjustable setting. The knob further carries a releasable latch that may extend radially outward relative to the knob to retain the indicator ring on the knob when the latch is in the latched position. When the shooter desires to remove and replace the indicator ring, such as in response to a change in shooting conditions, the latch may be released to an unlatched position to allow the indicator ring to be moved off of the knob. The shooter may thereafter insert a replacement indicator ring on the knob.

10 Claims, 4 Drawing Sheets

RIFLESCOPE ADJUSTMENT KNOB WITH INTERCHANGEABLE ADJUSTMENT INDICATOR RING

TECHNICAL FIELD

The field of the present disclosure relates generally to rotating adjustment knobs for a sighting device, such as a riflescope, a telescope, or other aimed optical device, and in particular, to such knobs configured to allow a shooter to quickly exchange an indicator ring bearing a scale in response to changed shooting conditions.

BACKGROUND

Sighting devices such as riflescopes have long been used in conjunction with weapons and firearms, such as rifles, handguns, and crossbows, to allow a shooter to accurately aim at a selected target. Because bullet and arrow trajectory, wind conditions, and distance to the target can vary depending upon shooting conditions, quality sighting devices typically provide compensation for variations in these conditions by allowing a shooter to make incremental adjustments to the optical characteristics or the aiming of the sighting device relative to the weapon surface on which it is mounted. These adjustments are known as elevation and windage adjustments, and are typically accomplished by lateral movement of an adjusting member, such as a reticle located within the riflescope, as shown in U.S. Pat. No. 3,058,391 of Leupold, or movement of one or more lenses within a housing of the riflescope, as shown in U.S. Pat. Nos. 3,297,389 and 4,408,842 of Gibson, and U.S. Pat. No. 7,827,723 of Zaderey et al.

The shooter typically makes such adjustments using rotatable adjustment knobs to actuate the adjustable member of the sighting device. In some riflescopes, an index mark on the housing of the riflescope provides a reference by which a shooter may read a scale marked around the circumference of the adjustment knob. These scales typically are finely tuned for specific weapons, weapon types, ammunition characteristics, distances, atmospheric conditions, and a host of other variables. Accordingly, scales tuned for one set of conditions may be inaccurate when used with different ammunition, weapons, geographic elevation, and/or temperature for which the scale was calibrated. Thus, when a shooter faces changes in shooting conditions, the shooter may desire to replace the scale with a suitable scale that is appropriately calibrated to provide the proper reference for the new shooting conditions.

In some systems, such as the assemblies described in U.S. Pat. No. 7,997,163 and U.S. Pat. Pub. No. 2008/0289239, the adjustment knob includes a scale etched, inscribed, or otherwise marked on a portion of the adjustment knob. In such assemblies, the shooter uses a tool to disengage a screw or a pin retaining the knob on the riflescope. The knob is thereafter removed and replaced with a different knob having a properly calibrated scale intended to be used for the new shooting conditions.

Other systems, such as the assembly described in U.S. Pat. No. 8,001,714, use ballistics calculations and other calibration data in conjunction with a label making apparatus to generate a printed label with dial-calibration data customized to different types of projectiles and different shooting conditions. A number of individual labels may be generated with calibration data for different projectiles, shooting conditions, etc. Thereafter, each label may be taped or otherwise affixed around a turret to create a number of customized turrets suitable for different types of projectiles and/or shooting conditions. In a similar system using labels bearing calibration data, such as the system described in U.S. Pat. No. 4,285,137, the labels may simply be removed and replaced on the knob as needed.

The present inventor has recognized a number of disadvantages associated with such riflescope configurations. One disadvantage is that a shooter will have to purchase and carry various knobs for a number of different shooting conditions. In addition, replacing the knob typically requires the shooter to carry and use tools, such as a hex key, to remove and refasten set screws or other fasteners that mount the knob to the riflescope housing, and there is a risk of dropping or losing components during the replacement process.

The present inventor has, thus, recognized a need for an improved knob assembly with an easily exchangeable scale for quickly adjusting to changes in shooting conditions without requiring the use of tools or removing the knob assembly from the riflescope housing to effectuate such exchanges.

Additional aspects and advantages will be apparent from the following detailed description of preferred embodiments, which proceeds with reference to the accompanying drawings.

DETAILED DESCRIPTION OF PREFERRED EMBODIMENTS

With reference to the drawings, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

FIGS. 1-6 illustrate various detailed views of an adjustment device 100 that may be used to change an adjustable setting of a riflescope 50 or other aiming device, and that includes an indicator ring 160 bearing a scale 165 to provide a reference point to the shooter regarding an adjustment position of the device 100 and the adjustable setting of riflescope 50. Adjustment device 100 is configured for easily exchanging indicator ring 160 to allow the shooter to quickly respond to variations in shooting conditions.

Figure 1:
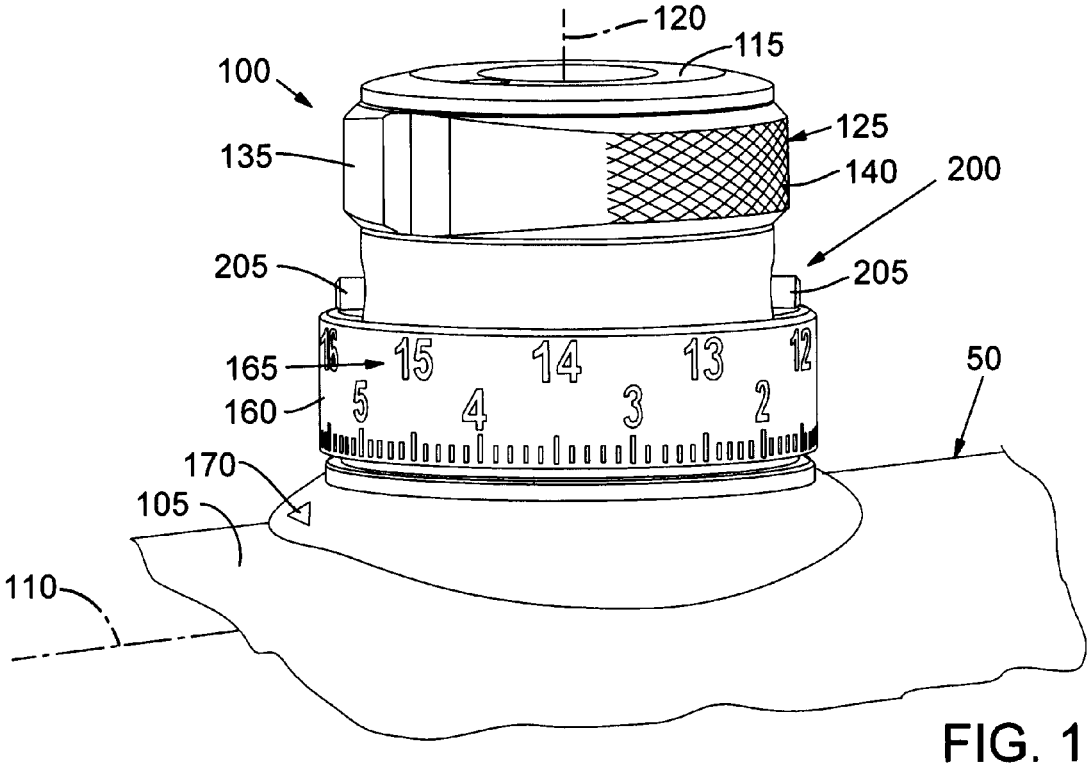
FIG. 1 is a side elevation view of an adjustment knob bearing an indicator ring, and illustrating a latch in a latched position to retain the indicator ring on the adjustment knob.
Figure 2:
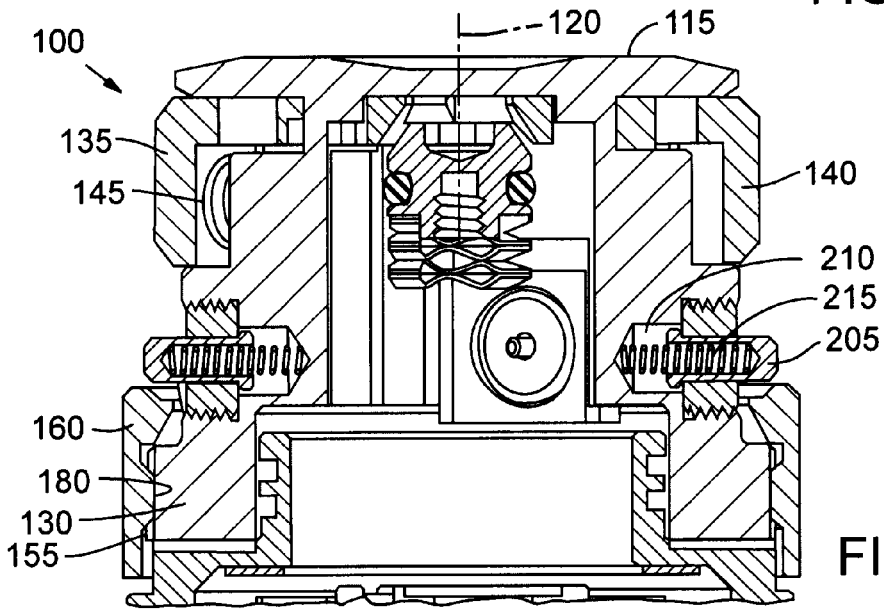
FIG. 2 is a cross-sectional view of the adjustment knob of FIG. 1 taken through a center line of the latch.
Figure 3:
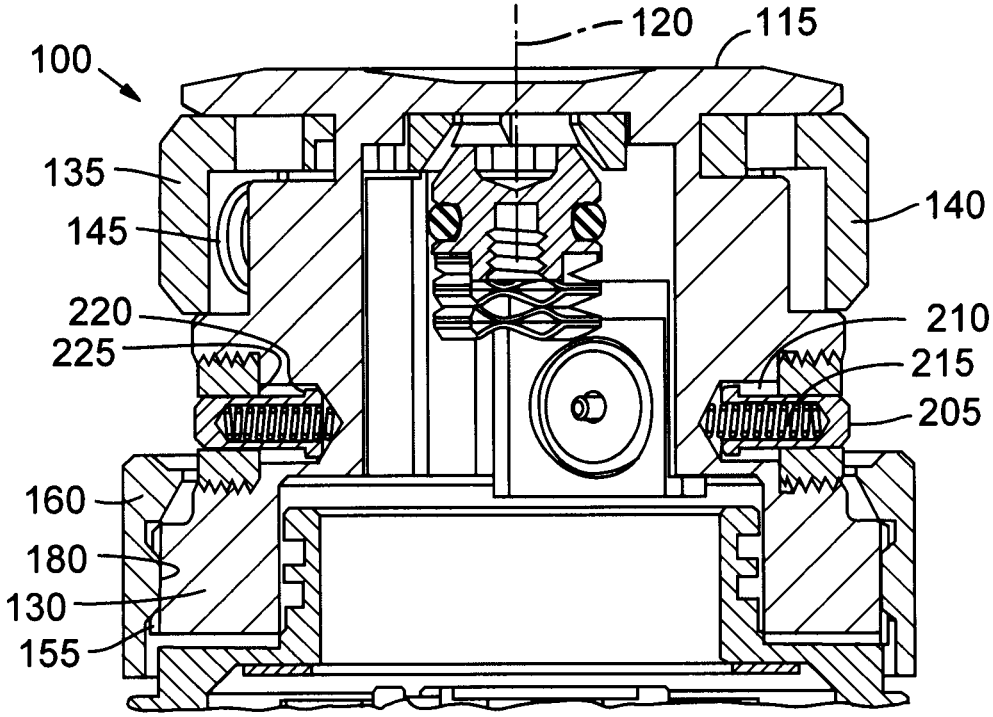
FIG. 3 is a cross-sectional view of the adjustment knob of FIG. 1 illustrating the latch in an unlatched position.

With particular reference to FIGS. 1-3, adjustment device 100 includes a knob 115, where adjustments may be made by rotation of knob 115 about a rotational axis 120. Knob 115 carries a manually actuatable latch 200 configured to move between a latched and unlatched position. When in a latched position, latch 200 retains indicator ring 160 against a lower base portion 130 of knob 115 and substantially inhibits sliding or other movement of indicator ring 160 along axis 120 (i.e., movement in an upward direction away from knob 115). Latch 200 will be in a latched position when knob 115 is turned to adjust settings of riflescope 50. When replacement of indicator ring 160 is required, such as to accommodate a changed shooting condition (e.g., change in elevation and/or temperature), latch 200 may be manually actuated to an unlatched position, whereby indicator ring 160 is free to slide along axis 120 and away from lower base portion 130 of knob 115 (see FIGS. 4-6). Once indicator ring 160 has been removed, a different replacement indicator ring (not shown) may be fitted onto knob 115 by sliding the replacement ring past latch 200 and onto lower base portion 130 of knob 115.

The following describes further detailed aspects of this and other embodiments of the adjustment device 100. In the following description of the figures and any example embodiments, reference may be made to using the adjustment device disclosed herein to actuate an adjustable member of a sighting device on a weapon or firearm, such as for making elevation and windage adjustments. It should be understood that any such references merely refer to one prospective use for such an adjustment device and should not be considered as limiting. Other uses for such adjustment devices with the characteristics and features described herein are possible, including use in other mechanical or electrical devices for making adjustments. In addition, although the following description is made with reference to a single adjustment device, the riflescope or other device may include multiple such adjustment devices.

In the following detailed description, the structure and function of some interior components of adjustment device 100, such as a spindle, plunger, retaining rings, and other components, are not described in detail herein to avoid obscuring pertinent aspects of the embodiments described herein. It should be understood that such components of the adjustment device 100 may be arranged in a variety of configurations. For instance, in some embodiments, the internal mechanism of adjustment device 100 may be configured as described in U.S. Pub. No. 2011/0100152, U.S. Pat. Nos. 6,279,259, 6,351,907, 6,519,890, or 6,691,447, the disclosures of which are incorporated by reference herein. In other embodiments, the adjustment device may have different mechanical arrangements and accompanying structures for effecting a mechanical, electrical, and/or optical adjustment.

With particular reference to FIGS. 1-2, adjustment device 100 is mounted to a main tube 105 of riflescope 50. Within main tube 105, at least one adjustable element, such as a reticle, lens assembly, or other optical or electrical elements, may be movably mounted in a substantially perpendicular orientation relative to a longitudinal tube axis 110. Rotation of knob 115 about rotational axis 120 actuates these adjustable elements to adjust a desired characteristic of the sighting device.

Knob 115 includes a gripping surface 125 and a lower base portion 130. Gripping surface 125 may partially or entirely encircle knob 115 and may be notched, fluted, knurled, or otherwise textured to provide a surface for the user to grip when manually rotating knob 115. In some embodiments, gripping surface 125 may include a pair of manually actuatable buttons 135, 140 spaced apart from each other and positioned on opposite sides of gripping surface 125, the buttons 135, 140 being spring-biased to automatically lock knob 115 to prevent inadvertent rotation of knob 115 as described in U.S. Pub. No. 2011/0100152. In an example operation, knob 115 may be unlocked by squeezing or radially pinching buttons 135, 140, such as between a user's thumb and forefinger, to move buttons 135, 140 inwardly toward rotational axis 120 and against the bias of a spring 145. Such inward movement of buttons 135, 140 dislodges a locking pin (not shown) to allow rotation of knob 115 about axis 120. When buttons 135, 140 are released, spring 145 urges buttons 135, 140 to move in a radially outward direction and the locking pin returns back to a locked position, thereby preventing further rotation of knob 115. Further details of the locking pin and accompanying structures of such an automatic locking device are described in U.S. Pub. No. 2011/0100152.

Figure 5:
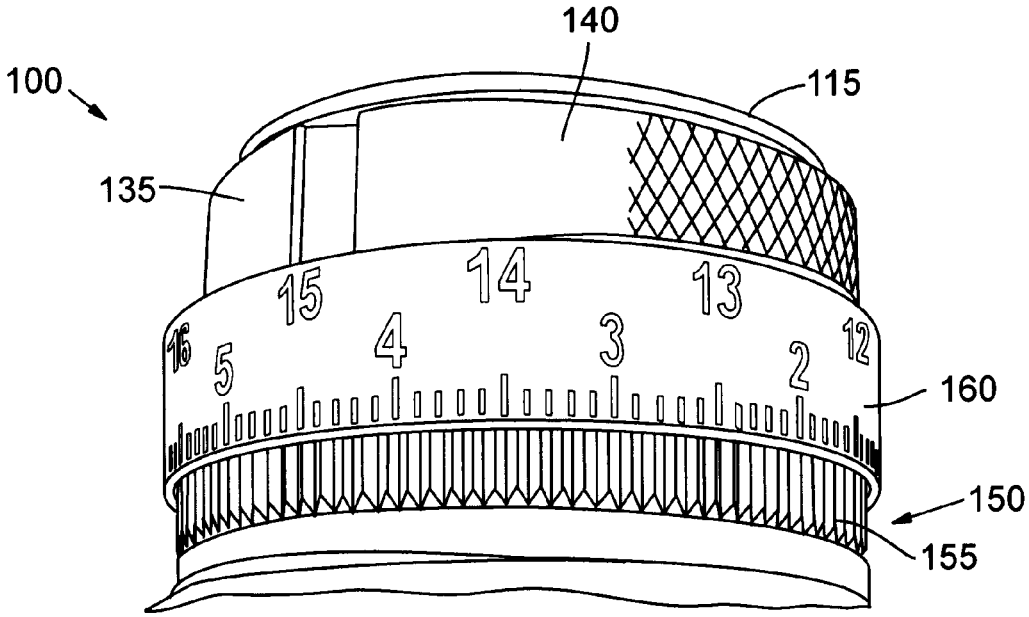
FIG. 5 is a side elevation view of the adjustment knob of FIG. 4.

Lower base portion 130 of knob 115 includes a receiving surface 150 with a number of uniformly incremented engagement features 155 spaced around its circumference (see FIG. 5). In one embodiment, engagement features 155 may include splines or a series of evenly spaced vertical grooves or ridges. In other embodiments, engagement features 155 may include a series of detents, indentations, apertures, recesses, or other suitable features evenly spaced around receiving surface 150. In still other embodiments, engagement features 155 may not be evenly spaced or may not extend around the entire circumference of receiving surface 150.

In an assembled configuration, knob 115 further includes an indicator ring 160 slidable around knob 115 and encircling lower base portion 130. Indicator ring 160 is marked with a scale 165 that allows the user to take a reading with respect to an index mark 170 located on riflescope 50. In some embodiments, scale 165 may be marked around a portion or the entire circumference of indicator ring 160 and may include calibration markings corresponding to MOA intervals, distance intervals, or any other desired measurements. The markings may be divided into any number of major intervals, such as 1 MOA intervals, and minor intervals, such as ¼ MOA increments. In other embodiments, the markings may be divided and subdivided into any configuration and/or intervals as desired.

Figure 6:
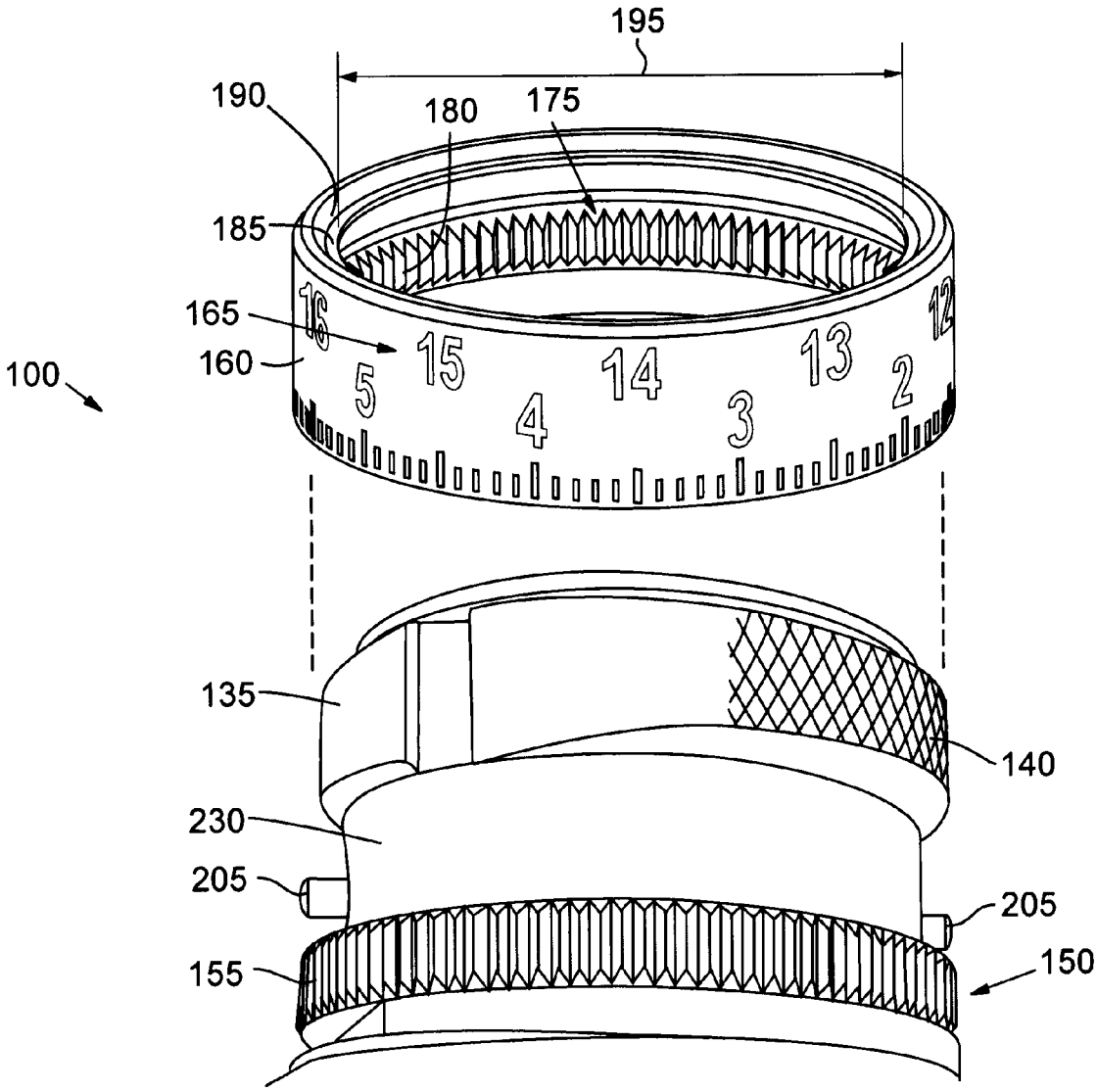
FIG. 6 is a side elevation view of the adjustment knob of FIG. 1 with the indicator ring fully removed.

With particular reference to FIG. 6, indicator ring 160 includes an engaging surface 175 having grooves, ridges, or other similar engagement features 180 keyed to mate with those on receiving surface 150 of knob 115. In an assembled configuration, indicator ring 160 slips over and around knob 115 and slides downwardly along axis 120 to receiving surface 150, where engagement features 155 on receiving surface 150 align with grooves 180 on engaging surface 175. When so aligned, indicator ring 160 rotates about axis 120 with knob 115 when knob 115 is rotated, but is otherwise prevented from independently rotating about axis 120.

In some embodiments, indicator ring 160 may include a lip or ridged section 185 extending from an inner surface 190 of indicator ring 160. Lip section 185 is preferably an integral structure of indicator ring 160 and extends partially or entirely around inner surface 190 to define an inner circumference 195. In other embodiments, lip 185 may be a separate structure from indicator ring 160, such as an annular ring that is adhered to or otherwise attached to inner surface 190 of indicator ring 160. Further details and functional aspects of lip 185 are discussed below reference to latch 200.

As mentioned previously, when shooting conditions change, a shooter may desire to replace the scale on the adjustment dial or knob with a different scale bearing a different set of markings to adjust the riflescope for new shooting conditions. The following describes one example embodiment of an adjustment device 100 configured for allowing a shooter to quickly and easily exchange such scale in response to changed shooting conditions.

In one embodiment, knob 115 includes a latch 200 configured to retain indicator ring 160 against knob 115 when latch 200 is in a latched position, and to allow free movement of indicator ring 160 away from or off of knob 115 when latch 200 is in an unlatched position. Latch 200 may comprise one of a variety of mechanisms configured to be moved between a latched position, where the latch 200 retains indicator ring 160 on knob 115, and an unlatched position, where the latch 200 allows removal of indicator ring 160 off of knob 115.

For instance, in one embodiment, latch 200 includes a pair of pins 205 each carried by knob 115 in an elongated bore 210. A spring 215, or other biasing element, exerts a force on pins 205 and urges pins 205 to extend radially outwardly from bore 210 such that pins 205 protrude outwardly from knob 115. Pins 205 may include a necked region 220 that bears against an internal shoulder region 225 of knob 115 to retain pins 205 within bore 210 and counteract the force exerted by spring 215. It should be understood that in other embodiments, latch 200 may include only one pin or may include more than two pins arranged in a similar fashion as described.

With particular reference to FIGS. 2-3, latch 200 may be manually actuatable or depressible to transition from a latched position (as shown in FIG. 2) to an unlatched position (as shown in FIG. 3). In the latched position, springs 215 urge pins 205 outwardly from knob 115 to bear against lip 185 and thereby prevent upward movement of indicator ring 160 along axis 120. In some embodiments, pins 205 may not directly bear against lip 185 in the latched position, but there may instead be a small clearance or gap between pins 205 and lip 185 such that indicator ring 160 may move slightly when pulled upwardly before pins 205 inhibit further movement. Preferably, pins 205 are positioned and dimensioned so as to maintain contact between engagement surfaces 150, 175 of adjustment knob 115 and indicator ring 160, respectively.

Figure 4:
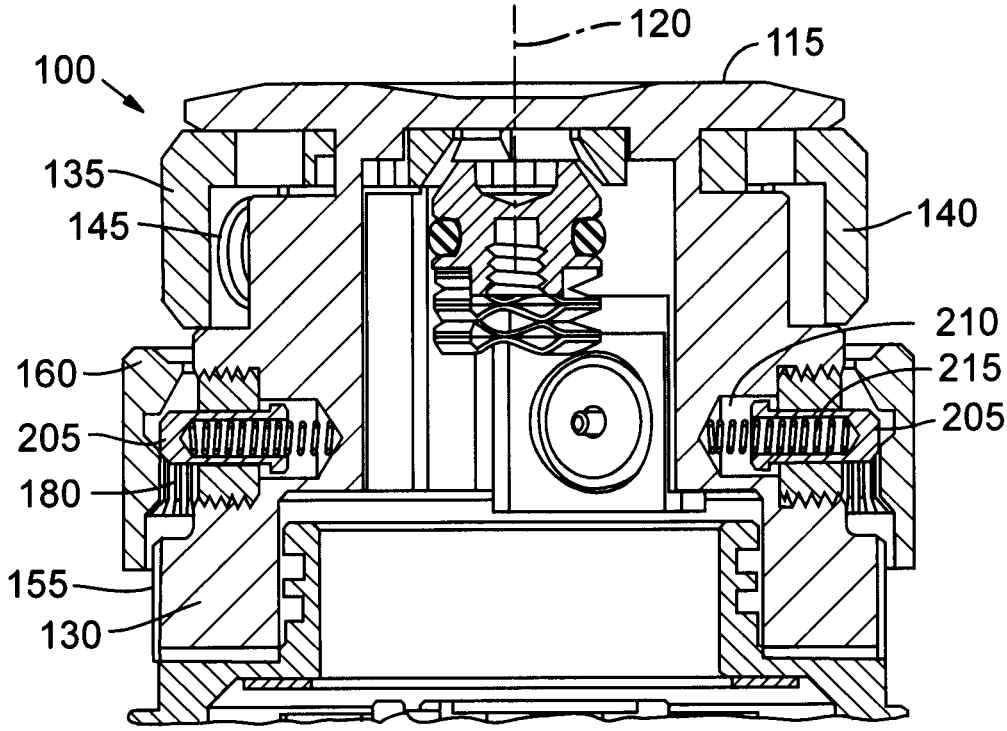
FIG. 4 is a cross-sectional view of the adjustment knob of FIG. 1 with the indicator ring in a partially released condition.

With particular reference to FIGS. 3-6, to unlock latch 200, pins 205 may be depressed inwardly or radially pinched (e.g., pinched between a thumb and forefinger) until they retract partially or entirely within bore 210. Once pins 205 have been retracted, indicator ring 160 is free to slide upwardly along axis 120 and away from lower base portion 130 of knob 115 toward gripping surface 125 (as shown in FIG. 4). In one example operation, a user may use one hand to pinch pins 205 inwardly and use the other hand to pull or slide indicator ring 160 upwardly. As indicator ring 160 approaches pins 205, the user releases pins 205, which may then automatically return to the latched position in response to the biasing force from springs 215. Once released, pins 205 may or may not contact inner surface 190 (or lip 185) of indicator ring 160, but in any case, pins 205 will no longer further interfere or otherwise inhibit continued upward movement of indicator ring 160.

Once indicator ring 160 has been removed, a replacement indicator ring may be installed on knob 115 by sliding it over knob 115 in a similar fashion as described previously. In particular, the replacement ring slides past gripping surface 125 and latch 200, and engages receiving surface 150 on lower base portion 130 of knob 115. Once the replacement indicator ring is positioned around lower base portion 130 and in engagement with receiving surface 150, pins 205 retain the replacement indicator ring on knob 115.

In another embodiment, the latch (e.g., latch 200) may include one or more magnets configured for releasably retaining the indicator ring on the knob. In such embodiments, the attraction of the magnets retain the indicator ring on the knob. To remove the indicator ring, the shooter may pull the indicator ring upwardly along the rotational axis (e.g., axis 120) with sufficient force to overcome the coupling of the magnetic latch. Thereafter, a replacement indicator ring may be slid over the knob and coupled thereto via the magnets. In some embodiments, the magnetic latch may eliminate the need of having separate engagement surfaces on the indicator ring and the knob, respectively, since the magnetic latch both retains and fixes the indicator ring onto the knob to promote rotation of the indicator ring with the knob when the knob is rotated.

In other embodiments, the latch may include a different mechanical fitting, such as a bayonet-type mount. For instance, the knob may include a number of tabs spaced around its body and the indicator ring may include a number of matching recesses sized to engage the tabs. Once the indicator ring is inserted over the knob, it may be twisted or turned a small amount to properly align the tabs and recesses to lock the indicator ring onto the knob.

In still other embodiments, the latch may include a spring-actuated system with one or more arms that may each extend radially outward from the knob. The arms may be linked to a mechanism (such as a lever or a button) carried by the knob, where actuation of the mechanism controls the movement of the arms to the locked and unlocked positions. For instance, in some embodiments, when the mechanism is manually actuated (e.g., depressed inwardly into the knob, pulled outwardly away from the knob, turned or rotated, etc.), the linked arms retract or are urged inwardly into the knob, thereby freeing the indicator ring and allowing it to be slid along the axis and off of the knob in a similar fashion as previously described.

In still other embodiments, the latch may incorporate other fittings or coupling systems, such as catches, bails, or rotating keepers for releasably retaining the indicator ring on the knob.

In some embodiments, buttons 135, 140 may form a secondary retention structure to retain indicator ring 160 around a central portion 230 of knob 115 after indicator ring 160 has been dislodged from receiving surface 150 during the removal and replacement process (see FIGS. 5-6). In one embodiment, actuatable buttons 135, 140 may have a larger circumference than inner circumference 195 of indicator ring 160 such that indicator ring 160 cannot (or does not) easily slide by actuatable buttons 135, 140 without an additional exertion of force by the shooter. In some embodiments, the user may simply apply additional pull force to slide indicator ring 160 past actuatable buttons 135, 140. In other embodiments, the shooter may first depress actuatable buttons 135, 140 inwardly (as previously described), thereby providing sufficient clearance to easily remove indicator ring 160.

Such configuration may be useful in providing a convenient holding place for indicator ring 160 while the shooter locates a replacement indicator ring. It may also provide a region to temporarily support indicator ring 160 and allow indicator ring 160 to rotate freely in relation to knob 115 so that the shooter can align a zero position of scale 165 with index mark 170 to calibrate riflescope 50. Once zeroed, the shooter may thereafter push indicator ring 160 downwardly past pins 205 and around lower base portion 130 to lock indicator ring 160 in position.

It will be obvious to those having skill in the art that many changes may be made to the details of the above-described embodiments without departing from the underlying principles of the invention. The scope of the present invention should, therefore, be determined only by the following claims.

The invention claimed is:

1. An adjustment device for a riflescope or other aiming device, comprising:

a knob mountable on the aiming device for rotation about an axis to drive an adjustment member of the aiming device, the knob including a first bore and an opposite second bore each extending in a radial direction relative to the knob wherein the second bore is linearly aligned with the first bore;

a removable indicator ring slidable onto the knob along the axis for mounting thereon, when mounted, the indicator ring keyed to the knob for rotation therewith; and a latch carried by the knob, wherein the latch retains the indicator ring on the knob when in a latched position, and wherein the latch is releasable to an unlatched position to allow the indicator ring to be moved along the axis and off of the knob, the latch including;

a first retention pin carried by the knob in the first bore, the first retention pin extending radially outward from the first bore; and a second retention pin carried by the knob in the second bore, wherein the second retention pin extends radially outward from the second bore in an opposite direction from the first retention pin when the latch is in the latched position.

2. The adjustment device of claim 1, wherein the latch is manually actuatable, and wherein, in response to manual actuation of the latch, at least a portion of each of the first and second retention pins retracts inwardly into the knob.

3. The adjustment device of claim 1, further comprising:

a biasing element arranged within the first bore to urge the first retention pin to extend radially outward from the first bore. and a second biasing element arranged within the second bore to urge the second retention pin to extend radially outward from the second bore.

4. The adjustment device of claim 1, wherein the latch is manually actuatable, and wherein, in response to manual actuation of the latch, each of the first and second retention pins at least partially retract inwardly into the first and second bores.

5. The adjustment device of claim 1, further comprising a lip extending inwardly from an inner surface of the indicator ring, wherein the lip and the indicator ring are integrally formed as a single, unitary structure, and wherein the latch bears against the lip to retain the indicator ring on the knob when the latch is in the latched position.

6. The adjustment device of claim 1, wherein the knob further includes a lower base portion having a first set of features keyed to mate with a corresponding second set of features on an interior surface of the indicator ring to secure the indicator ring on the knob for rotation therewith.

7. The adjustment device of claim 1, wherein the indicator ring further includes indicia spaced apart and around the circumference of the indicator ring to facilitate fine adjustments for a shooting condition.

8. The adjustment device of claim 1, wherein the latch is manually actuatable from the latched position to an unlatched position.

9. The adjustment device of claim 8, wherein the latch automatically returns to the latched position from the unlatched position when the latch is no longer manually actuated.

10. The adjustment device of claim 8, where the first and second retention pins are each depressible.

* * * * *

UNITED STATES PATENT AND TRADEMARK OFFICE

CERTIFICATE OF CORRECTION

PATENT NO. : 8,806,798 B2
APPLICATION NO. : 13/683985
DATED : August 19, 2014
INVENTOR(S) : Quint Crispin It is certified that error appears in the above-identified patent and that said Letters Patent is hereby corrected as shown below:

In the Claims:

In column 7, line 17, change “including;” to --including:--.

In column 7, line 33, change “bore.” to --bore;--.

Signed and Sealed this
Twenty-first Day of April, 2015

Michelle K. Lee

Michelle K. Lee
*Director of the United States Patent and Trademark Office*